US009147538B2

(12) United States Patent
Cho

(10) Patent No.: US 9,147,538 B2
(45) Date of Patent: Sep. 29, 2015

(54) ELECTRONIC SWITCH

(71) Applicant: LSIS CO., LTD., Anyang-si, Gyeonggi-do (KR)

(72) Inventor: Tae Sik Cho, Cheongju-si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 67 days.

(21) Appl. No.: 13/921,061

(22) Filed: Jun. 18, 2013

(65) Prior Publication Data

US 2014/0001157 A1 Jan. 2, 2014

(30) Foreign Application Priority Data

Jun. 29, 2012 (KR) ..... 10-2012-0070638

(51) Int. Cl.

| | |
|---|---|
| ***H01H 33/04*** | (2006.01) |
| ***H01H 9/30*** | (2006.01) |
| ***H01H 9/34*** | (2006.01) |
| ***H01H 50/54*** | (2006.01) |
| ***H01H 50/02*** | (2006.01) |
| ***H01H 51/29*** | (2006.01) |

(52) U.S. Cl.

CPC ..... *H01H 33/04* (2013.01); *H01H 9/30* (2013.01); *H01H 51/29* (2013.01); *H01H 50/546* (2013.01); *H01H 2009/348* (2013.01); *H01H 2050/025* (2013.01)

(58) Field of Classification Search

CPC ... H01H 9/03; H01H 33/04; H01H 2050/025; H01H 49/00; H01H 50/023; H01H 50/54; H01H 2009/348; H01H 50/546; H01H 51/29

USPC ..... 218/30, 46, 37, 48, 68, 107, 128, 146; 335/126, 132, 201, 262, 292

See application file for complete search history.

(56) References Cited

U.S. PATENT DOCUMENTS

| | | | | |
|---|---|---|---|---|
| 4,228,332 | A * | 10/1980 | Ibuki et al. | 218/51 |
| 8,258,419 | B2 * | 9/2012 | Jeong et al. | 218/68 |
| 8,653,917 | B2 * | 2/2014 | Takaya et al. | 335/201 |
| 2012/0090149 | A1 | 4/2012 | Yeon | |

FOREIGN PATENT DOCUMENTS

| | | |
|---|---|---|
| CN | 2009-62406 | 10/2007 |
| DE | 9006430 | 9/1990 |

(Continued)

OTHER PUBLICATIONS

European Patent Office Application Serial No. 13172973.3, Search Report dated Oct. 17, 2013, 7 pages.

Japan Patent Office Application Serial No. 2013-136113, Notice of Allowance dated Oct. 28, 2014, 3 pages.

(Continued)

*Primary Examiner* — Renee Luebke
*Assistant Examiner* — William Bolton
(74) *Attorney, Agent, or Firm* — Lee, Hong, Degerman, Kang & Waimey

(57) ABSTRACT

Disclosed is an electronic switch. The electronic switch includes a fixed contact point; a movable contact point; and an actuating unit for moving the movable contact point, wherein at least one gas inflow space is formed in at least one of the fixed and movable contact points, a gas which is injected into a space where the fixed and movable contact points make contact with or are separated from each other flows into the at least one gas inflow space while the fixed and movable contact points make contact with each other, and the gas in the at least one gas inflow space is exhausted to the space where the fixed and movable contact points make contact with or are separated from each other while the fixed and movable contact points are separated from each other.

4 Claims, 5 Drawing Sheets

(56) References Cited

FOREIGN PATENT DOCUMENTS

| | | |
|---|---|---|
| EP | 2442332 | 4/2012 |
| JP | 60-123827 | 8/1985 |
| JP | 2012-038684 | 2/2012 |
| WO | 2012/073468 | 6/2012 |

OTHER PUBLICATIONS

The State Intellectual Property Office of the People's Republic of China Application Serial No. 201310269141.9, Office Action dated Jan. 23, 2015, 7 pages.

* cited by examiner

ELECTRONIC SWITCH

CROSS-REFERENCE TO RELATED APPLICATIONS

Pursuant to 35 U.S.C. §119(a), this application claims the benefit of earlier filing date and right of priority to Korean Patent Application No. 10-2012-0070638, filed on Jun. 29, 2012, the contents of which is incorporated by reference herein in its entirety.

BACKGROUND

The disclosure relates to an electronic switch.

An electronic switch is a kind of an electrical contact switching device for supplying or shutting off current, and is installed in various industrial equipments, machines or vehicles. Such an electronic switch includes a fixed contact point and a movable contact point which selectively make contact with each other, and an electric actuator for driving the movable contact point according to an electrical signal in order to allow the fixed and movable contact points to make contact with each other or to be separated from each other.

As generally known in the art, the electric actuator includes a coil for generating electromagnetic force, a fixed core fixed in the coil, a movable core movable closely to or away from the fixed core, a movable rod which moves in connection with the movement of the movable core and to which the movable contact point is fixed, and a return spring for applying elastic force to the movable core in order to allow the movable core to move away from the fixed core.

In this case, if power is applied to the coil, the magnetic field is generated from the coil and the movable core moves toward the fixed core while overcoming the elastic force of the return spring by Fleming's left-hand rule. Thus, the movable rod moves in the same direction with the movable core, so that the movable contact point makes contact with the fixed contact point.

To the contrary, if the power applied to the coil is shut off, the movable core moves away from the fixed core due to the elastic force of the return spring. Thus, the movable rod moves in the same direction with the movable core, so that the movable contact point is separated from the fixed contact point.

According to the related art described above, the movable contract point is separated from the fixed contact point only by the elastic power of the return spring. Thus, since the fixed contact point is not rapidly separated from the fixed contact point, arc having the high temperature is generated while the fixed and movable contact points are being separated from each other, so that the fixed contact point and/or the movable contact point may be damaged.

SUMMARY

The disclosure provides an electronic switch in which the fixed and movable contact points can be more rapidly separated from each other.

According to one embodiment, there is provided an electronic switch including a fixed contact point; a movable contact point making contact with or separated from the fixed contact point; and an actuating unit for moving the movable contact point in order to allow the movable contact point to make contact with or to be separated from the fixed contact point, wherein at least one gas inflow space is formed in at least one of the fixed and movable contact points, a gas which is injected into a space where the fixed and movable contact points make contact with or are separated from each other flows into the at least one gas inflow space while the fixed and movable contact points make contact with each other, and the gas in the at least one gas inflow space is exhausted to the space where the fixed and movable contact points make contact with or are separated from each other while the fixed and movable contact points are separated from each other.

The gas inflow space may be formed by concaving down a portion of the fixed or movable contact point.

The gas inflow spaces may be disposed symmetrically about a center of one surface of the fixed or movable contact point.

The gas inflow space may be placed on one surface of the fixed contact point which faces the movable contact point.

The gas may flow into the gas inflow space by the movable contact point which moves to make contact with the fixed contact point.

The gas which flows into the gas inflow space is heated by an arc generated while the fixed and movable contact points are separated from each other, so that an inner pressure of the gas inflow space may be increased and the gas which flows into the gas inflow space may be exhausted into the space in which the fixed and movable contact points make contact with or are separated from each other.

One surface of the fixed contact point which faces the movable contact point may make surface-contact with one surface of the movable contact point which faces the fixed contact point.

According to the embodiment, the electronic switch includes the gas inflow space formed in the fixed contact point, and thus, the movable contact point can be separated from the fixed contact point by the gas exhausting to an outside of the gas inflow space. Therefore, the damage of the fixed contact point and/or the movable contact point, which is caused by the arc generated while the movable contact point is being separated from the fixed contact point, can be minimized, so that the durability and operation reliability of the product can be improved.

DETAILED DESCRIPTION OF THE EMBODIMENTS

Hereinafter, an electronic switch according to the first embodiment will be described with reference to accompanying drawings in detail.

Figure 1:
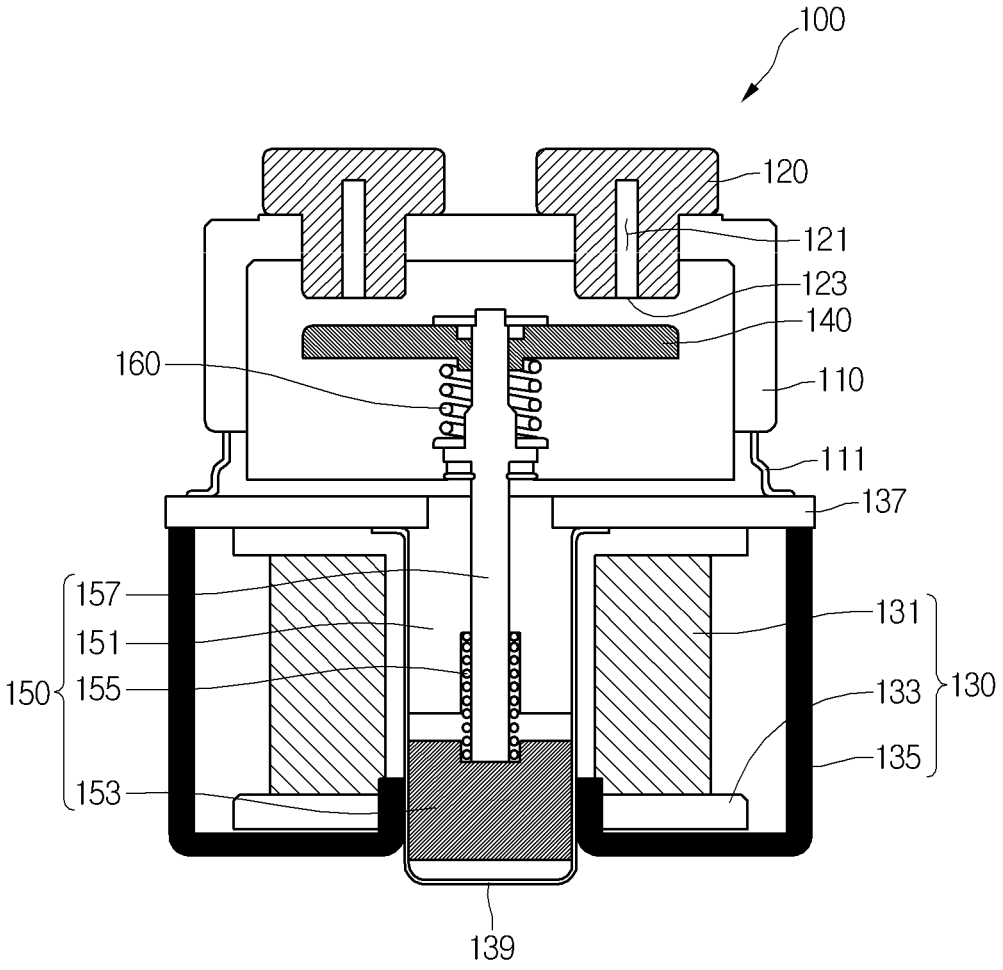
FIG. 1 is a longitudinal sectional view showing the electronic switch according to the first embodiment.
Figure 2:
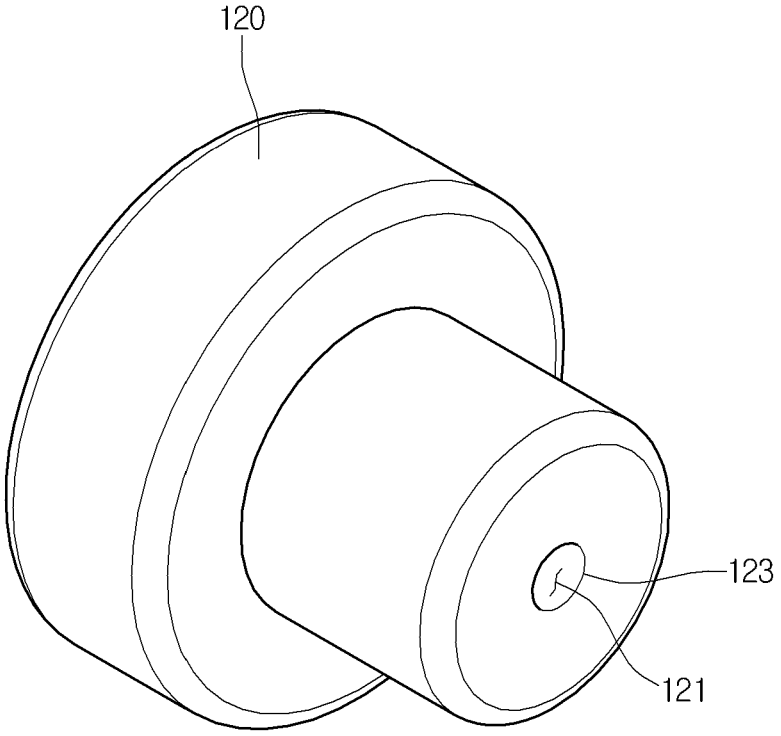
FIG. 2 is a perspective view showing a fixed contact point according to the first embodiment.

FIG. 1 is a longitudinal sectional view showing the electronic switch according to the first embodiment. FIG. 2 is a perspective view showing a fixed contact point included in the first embodiment.

Referring to FIG. 1, the electronic switch 100 may be placed at an outmost place in a housing 110. The electronic switch 100 may be formed in a polyhedral shape and have a hollow and an opened low surface. A seal cup 111 for connecting with a seal plate 137 which will be described below is provided at a low end of the housing 110.

Meanwhile, gas for arc extinction is injected into the housing 110. For example, hydrogen ($H_2$) and nitrogen ($N_2$) may be injected into the housing 110 at the ratio of about 9:1.

A fixed contact point 120 is installed in the housing 110. The fixed contact point 120 is installed while passing through a top surface of the housing 110, such that at least one portion of the fixed contact point 120 is placed in the housing 110.

In the embodiment, a gas inflow space 121 is formed in the fixed contact point 120. The gas inflow space 121 may be formed on one surface of the fixed contact point 120, one surface of a movable contact point 140 which will be described below, or both of the fixed and movable contact points 120 and 140. However, as one example, the case that the gas inflow space 121 is formed on one surface of the fixed contact point 120 will be described in the embodiment. One portion of the fixed contact point 120 is concaved such that the gas inflow space 121 is formed. In more detail, one surface of the fixed contact point 120, which faces the movable contact point 140, is concaved therein, so that the gas inflow space 121 is formed. An inlet 123 of the gas inflow space 121 is placed on a low surface of the fixed contact point 120 which makes contact with the movable contact point 140. Gas flows into the gas inflow space 121 while the movable contact point 140 is making contact with the fixed contact point 120.

Further, a coil assembly 130 is installed in the housing 110. The coil assembly 130 includes a coil 131, a bobbin 133 and a yoke 135. The coil 131 is wound around an outer surface of the bobbin 133 which is formed in a cylindrical shape and has a hollow. The coil 131 generates an electromagnetic field when current is applied to the coil 131. The yoke 135 has a polyhedral shape surrounding the bobbin 133 and the coil 131.

Meanwhile, the seal plate 137 is installed on the top surface of the yoke 135. The seal plate 137 substantially seals an opened top surface of the yoke 135.

A cylinder 139 extends by passing through the yoke 135. The cylinder 139 may be formed in a hollow cylindrical shape and may be placed in a longitudinal direction. The top surface of the cylinder 139 may be opened and the top end of the cylinder 139 may make contact with the low surface of the seal plate 137.

The movable contact point 140 is movably installed in the housing 110. The movable contact point 140 makes contact with or is separated from the fixed contact point 120. One surface of the movable contact point 140 which faces the fixed contact point 120 is capable of making surface-contact with one surface of the fixed contact point 120 which faces the movable contact point 140. If the movable contact point 140 makes contact with the fixed contact point 120, the electronic switch 100 is switched on so that power is supplied to a load. If the movable contact point 140 is separated from the fixed contact point 120, the electronic switch 100 is switched off so that power is shut off.

In the embodiment, the movable contact point 140 allows the inlet 123 of the gas inflow space 121 to be selectively turned on or off. In other words, in the state that the fixed contact point 120 makes contact with the movable contact point 140, the movable contact point 140 allows the inlet 123 of the gas inflow space 121 to be closed. If the movable contact point 140 is spaced apart from the fixed contact point 120, the movable contact point 140 allows the inlet 123 of the gas inflow space 121 to be opened.

Meanwhile, the movable contact point 140 moves by an actuating unit 150, so that the movable contact point 140 makes contact with or is spaced apart from the fixed contact point 120. The actuating unit 150 includes a fixed core 151 fixed inn the cylinder 139, a movable core 153 movably installed in the cylinder 139, a return spring 155 of providing elastic force to the movable core 153, and a movable shaft 157 of moving together with the movable core 153.

In more detail, the fixed core 151 is fixed at an upper portion in the cylinder 139. A low end of the fixed core 151 is spaced apart from a low end of the cylinder 139 by a predetermined distance.

The movable core 153 is placed in the cylinder 139, which corresponds to a low portion of the fixed core 151. The movable core 153 moves closely the fixed coil 151 due to the electromagnetic filed generated from the coil 131.

The return spring 155 applies elastic force to the movable core 153 such that the movable core 153 moves in a direction to be spaced apart from the fixed core 151. For example, a coil spring may serve as the return spring 155. The coil spring is placed between the fixed and movable cores 151 and 153 and has both ends which are supported by the fixed and movable cores 151 and 153.

Further, the elastic force of a wipe spring 160 is provided to the movable core 153. The wipe spring 160 provide a contact pressure to the movable core 153 such that the contact state of the movable core 152 with the fixed contact point 120 is maintained.

Hereinafter, the electronic switch according to the first embodiment will be described in detail with reference to accompanying drawings.

Figure 3:
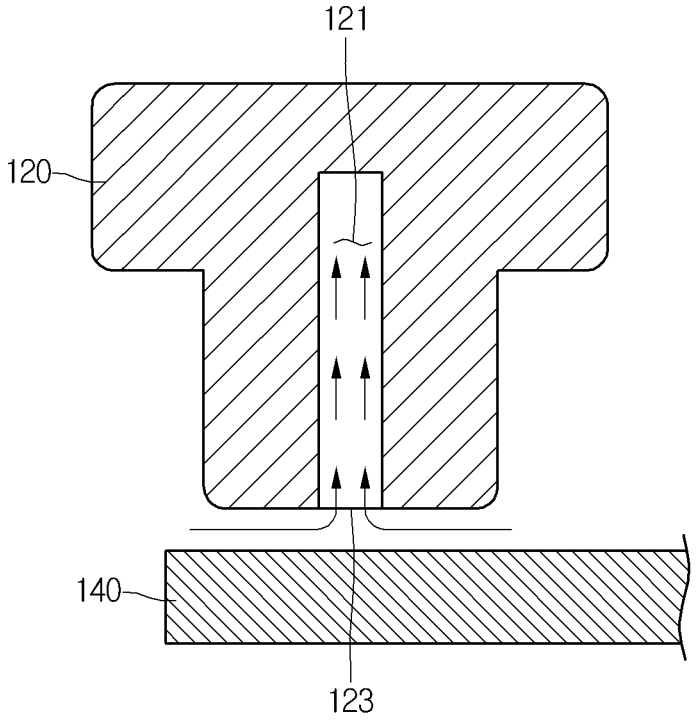
FIGS. 3 to 5 are views showing the states of an off-operation of the electronic switch according to the first embodiment.
Figure 4:
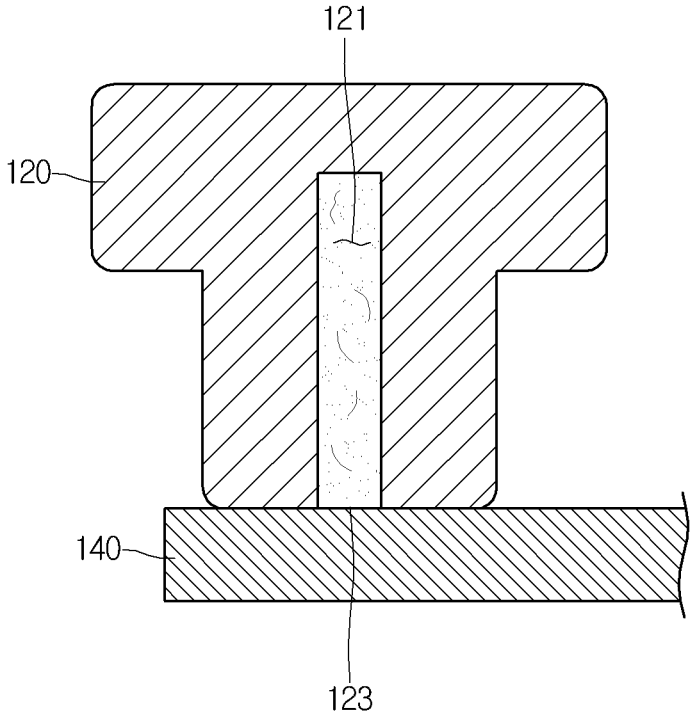
Figure 5:
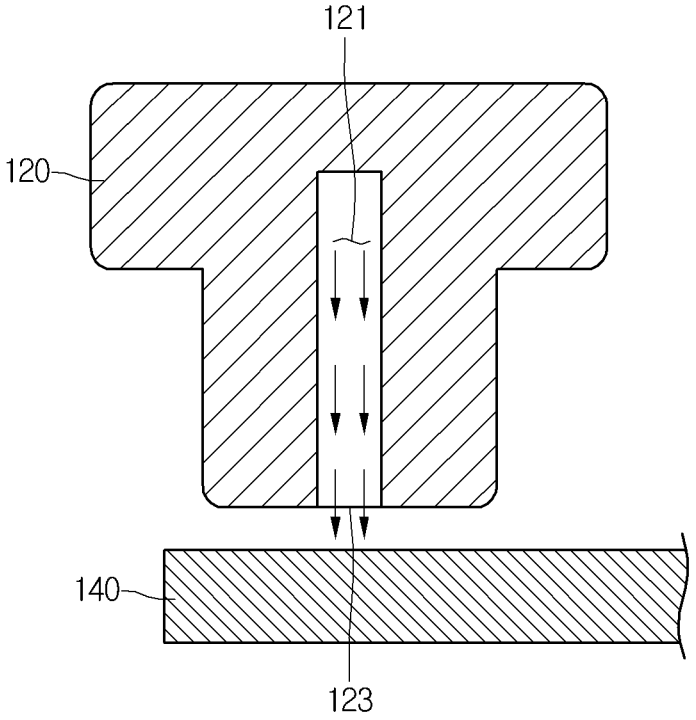

FIGS. 3 to 5 are views showing the states of an off-operation of the electronic switch according the first embodiment.

First, when the electronic switch 100 is switched on, power is supplied to the coil 131. Thus, the magnetic field is generated from the coil 131 and the movable core 153 moves toward the fixed core 151 while overcoming the elastic force of the return spring 155 by Fleming's left-hand rule. As shown in FIG. 3, as the movable core 153 moves, the movable contact point 140 moves toward the fixed contact point 120. Thus, while the movable contact point 140 moves to make contact with the fixed contact point 120, the gas stored in the housing 110 flows into the gas inflow space 121. As shown in FIG. 4, if the fixed and movable contact points 120 and 140 make contact with each other, the inlet 123 of the gas inflow space 121 is closed by the movable contact point 140.

Next, if the electronic switch 100 is switched off, the power supplied to the coil 131 is shut off. Thus, due to the elastic force of the return spring 155, the movable core 153 moves in the direction so that movable core 153 is spaced apart from the fixed core 151. As shown in FIG. 5, as the movable core 153 moves, the movable contact point 140 is spaced apart from the fixed contact point 120.

Meanwhile, while the fixed and movable contact points 120 and 140 are separated from each other, an arc having high temperature is generated. Then, the gas which is reserved in the gas inflow space 121 is substantially heated by the arc. Thus, as the gas which flows into the gas inflow space 121 is increased, the internal pressure of the gas inflow space 121 is increased.

In this case, when the movable contact point 140 moves to be spaced apart from the fixed contact point 120, the inlet 123 of the gas inflow space 121 is opened. As described above, since the inside of the gas inflow space 121 has a relatively high pressure, if the inlet 123 of the gas inflow space 121 is opened, the gas in the gas inflow space 121 is exhausted to an outside. Thus, since the movable contact point 140 is pressed by the gas that is exhausted from the inside to the outside of the gas inflow space 121, the movable contact point 140 can be separated rapidly and substantially from the fixed contact point 120.

Hereinafter, the electronic switch according to the second embodiment will be described in more detail with reference to the accompanying drawings.

Figure 6:
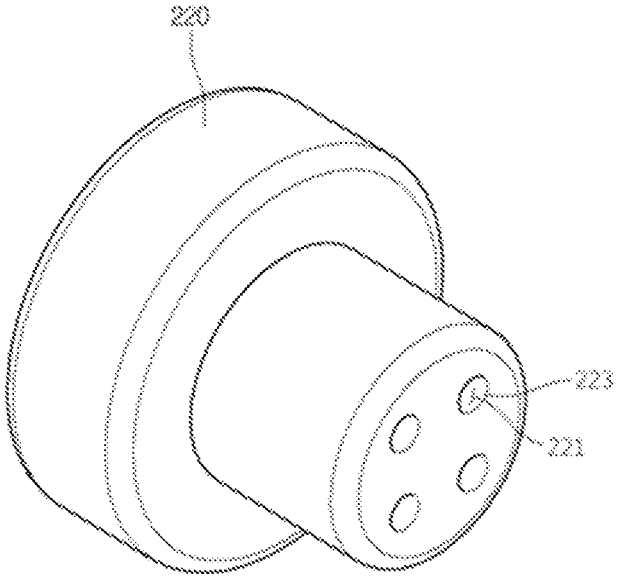
FIG. 6 is a perspective view showing a fixed contact point included in an electronic switch according to the second embodiment.

FIG. 6 is a perspective view showing a fixed contact point of an electronic switch according to the second embodiment. The same reference numerals as those used in FIGS. 1 to 4 according to the first embodiment are assigned to the same portions as those used in FIGS. 1 to 4 according to the first embodiment and the detailed descriptions are omitted.

Referring to FIG. 6, according to the present embodiment, a plurality of gas inflow spaces 221 are provided in a fixed contact point 220. An inlet 223 of the gas inflow space 221 is placed at one surface of the fixed contact point 220. Substantially, the inlet 223 is placed at one surface of the fixed contact point 220 making contact with the movable contact point 140. The gas inflow space 221 is disposed symmetrically with respect to the center of the cross section of the fixed contact point 220. Substantially, the gas inflow space 221 is disposed symmetrically with respect to the center of the one surface of the fixed contact point 220 which makes contact with the movable contact point 140. This is for applying substantially uniform external force over the whole area of the movable contact point 140 by the gas exhausted from the inside of the gas inflow space 221 to an outside. Thus, according to the embodiment, in the process of separating the fixed and movable contact points 220 and 140 from each other, the contact portions of both points can be separated entirely and uniformly from each other.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electronic switch comprising:

a fixed contact point;

a movable contact point movable between a first position making contact with the fixed contact point and a second position separated from the fixed contact point; and an actuating unit configured to move the movable contact point between the first position and the second position;

wherein a plurality of gas inflow spaces are symmetrically disposed about a center point at a surface of the fixed contact point facing the movable contact point;

wherein a gas is injected into a space defined by a housing where the fixed and movable contact points make contact with each other and the gas flows into the plurality of gas inflow spaces and an internal pressure of the gas in the plurality of gas inflow spaces is increased when the fixed and movable contact points make contact with each other;

wherein the gas in the plurality of gas inflow spaces is exhausted to the space defined by the housing and the movable contact is moved away from the fixed contact point by the gas exhausted to the space defined by the housing when the fixed and movable contact points are separated from each other; and wherein the plurality of gas inflow spaces are concave with respect to the surface of the fixed contact point.

2. The electronic switch of claim 1, wherein the gas flows into the plurality of gas inflow spaces when the movable contact point is moved to the first position.

3. The electronic switch of claim 1, wherein an inner pressure of one of the plurality of gas inflow spaces is increased when an arc is generated while the fixed and movable contact points are separated from each other such that the gas is exhausted into the space defined by the housing.

4. The electronic switch of claim 1, wherein a surface of the fixed contact point which faces the movable contact point is configured to contact with a corresponding surface of the movable contact point which faces the fixed contact point.

* * * * *